US010504436B2

(12) United States Patent
He et al.

(10) Patent No.: US 10,504,436 B2
(45) Date of Patent: Dec. 10, 2019

(54) PIXEL DRIVING CIRCUITS, PIXEL DRIVING METHODS AND DISPLAY DEVICES

(71) Applicants: BOE Technology Group Co., Ltd., Beijing (CN); Chengdu BOE Optoelectronics Technology Co., Ltd., Sichuan (CN)

(72) Inventors: Xiaoxiang He, Beijing (CN); Xiaojing Qi, Beijing (CN); Yin Deng, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu (CN)

( * ) Notice: Subject to any disclaimer, the term of this patent is extended or adjusted under 35 U.S.C. 154(b) by 0 days.

(21) Appl. No.: 15/503,081

(22) PCT Filed: Jul. 4, 2016

(86) PCT No.: PCT/CN2016/088294

§ 371 (c)(1),
(2) Date: Feb. 10, 2017

(87) PCT Pub. No.: WO2017/117938

PCT Pub. Date: Jul. 13, 2017

(65) Prior Publication Data

US 2018/0108298 A1 Apr. 19, 2018

(30) Foreign Application Priority Data

Jan. 4, 2016 (CN) ..... 2016 1 0005060

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0426* (2013.01);
(Continued)

(58) Field of Classification Search
CPC ..... G09G 2300/3258; G09G 3/3233; G09G 3/3258; G09G 2300/0426;
(Continued)

(56) References Cited

U.S. PATENT DOCUMENTS 8,982,017 B2 3/2015 Lee et al.
9,349,318 B2 5/2016 Jung
(Continued)

FOREIGN PATENT DOCUMENTS

CN 103854609 A 6/2014
CN 104157241 A 11/2014
(Continued)

OTHER PUBLICATIONS

First Office Action, including Search Report, for Chinese Patent Application No. 201610005060.1, dated Aug. 3, 2017, 11 pages.
(Continued)

*Primary Examiner* — Sejoon Ahn
(74) *Attorney, Agent, or Firm* — Westman, Champlin & Koehler, P.A.

(57) ABSTRACT

The present disclosure relates to a pixel driving circuit, a pixel driving method and a display device. A voltage related to a threshold voltage of a driving unit is stored in a storage unit during a compensation stage of the pixel driving circuit utilizing a charging control unit so that an operating current of the driving unit is not affected by the threshold voltage during a light emitting holding stage of the pixel driving circuit. Thus, the influence of the threshold voltage of the driving unit on an operating current thereof is eliminated and an issue in which the display luminance of the light emitting
(Continued)

element is not uniform due to inconsistency in the threshold voltage is solved, which improves display quality of the display device.

1 Claim, 14 Drawing Sheets

(52) U.S. Cl.
CPC ..... *G09G 2300/0814* (2013.01); *G09G 2300/0819* (2013.01); *G09G 2300/0852* (2013.01); *G09G 2310/0251* (2013.01); *G09G 2320/0204* (2013.01); *G09G 2320/0233* (2013.01)

(58) Field of Classification Search
CPC ... G09G 2300/0814; G09G 2300/0819; G09G 2300/0852; G09G 2300/0251; G09G 2300/0204; G09G 2300/0233
See application file for complete search history.

(56) References Cited

U.S. PATENT DOCUMENTS

2005/0259051 A1* 11/2005 Lee ..... G09G 3/3233 345/76
2005/0264498 A1* 12/2005 Asano ..... G09G 3/3233 345/76
2006/0044235 A1* 3/2006 Lee ..... G09G 3/3233 345/82
2006/0066251 A1* 3/2006 Sim ..... G09G 3/3233 315/169.3
2006/0151745 A1* 7/2006 Kim ..... G09G 3/325 252/301.16
2007/0120118 A1* 5/2007 Kubota ..... H01L 27/326 257/40
2007/0194706 A1* 8/2007 Jung ..... G09G 3/3233 313/506
2008/0224965 A1* 9/2008 Kim ..... G09G 3/3233 345/76
2009/0051628 A1* 2/2009 Kwon ..... G09G 3/3233 345/77
2010/0157189 A1* 6/2010 Ma ..... G02F 1/136286 349/48
2011/0227885 A1* 9/2011 Chung ..... G09G 3/3241 345/204
2011/0316838 A1* 12/2011 Ahn ..... G09G 3/3225 345/211
2014/0118229 A1* 5/2014 Han ..... G09G 3/3233 345/82
2014/0152719 A1* 6/2014 Jung ..... G09G 3/3233 345/691
2015/0054722 A1* 2/2015 Kanda ..... G09G 3/3233 345/77
2015/0145849 A1* 5/2015 Choi ..... G09G 3/3233 345/212
2015/0170570 A1 6/2015 Kim et al.
2015/0379956 A1* 12/2015 Nonaka ..... G09G 3/3233 315/172
2016/0005384 A1* 1/2016 Yoon ..... G09G 3/3291 345/213
2016/0104427 A1* 4/2016 Matsueda ..... G09G 3/3233 345/212

FOREIGN PATENT DOCUMENTS

CN 104409047 A 3/2015
CN 104700782 A 6/2015
CN 105185300 A 12/2015
CN 105185305 A 12/2015
CN 105489168 A 4/2016
CN 205451748 U 8/2016

OTHER PUBLICATIONS

International Search Report and Written Opinion of International Application No. PCT/CN2016/088294, dated Oct. 10, 2016, 11 pages.
English translation of Box No. V of the Written Opinion for the International Searching Authority for International Application No. PCT/CN2016/088294, 2 pages.

* cited by examiner

PIXEL DRIVING CIRCUITS, PIXEL DRIVING METHODS AND DISPLAY DEVICES

CROSS-REFERENCE TO RELATED APPLICATION(S)

This application is a Section 371 National Stage Application of PCT/CN2016/088294, filed on Jul. 4, 2016, which has not yet published and claims priority to Chinese Application No. 201610005060.1, filed on Jan. 4, 2016 and entitled "PIXEL DRIVING CIRCUITS, PIXEL DRIVING METHODS AND DISPLAY DEVICES," which are incorporated herein by reference in their entirety.

TECHNICAL FIELD

The present disclosure relates to the field of display technology, and more particularly, to pixel driving circuits, pixel driving methods and display devices capable of improving display quality by compensating a threshold voltage of a driving circuit of a light emitting element.

BACKGROUND

Active Matrix Organic Light Emitting Diode (AMOLED) displays are hot in current flat panel display research. As compared with a liquid crystal display (LCD), an organic light emitting diode (OLED) has advantages such as low power consumption, low production costs, self-luminous, wide viewing angle, short response time and so on. At present, in the display field, such as mobile phones, PDAs, digital cameras and the like, the OLED display screens are taking places of traditional LCD display screens. Among others, pixel driving is core technical content for the AMOLED display, and has important research value.

Unlike thin film transistor-Liquid Crystal Displays (TFT-LCD), which use a stable voltage to control brightness, OLEDs are driven by current and require a constant current to control light emission. As shown in FIG. 1, a traditional AMOLED pixel driving circuit utilizes a 2T1C pixel driving circuit. The circuit consists of only one driving thin-film transistor T1, one switch thin-film transistor T2 and one storage capacitor C. When the scanning line gates (i.e. scans) a certain line, the scanning signal Vscan is a high level signal, the transistor T2 is turned on, and the data signal Vdata is written into the storage capacitor C. After the line is completely scanned, Vscan turns to be a low level signal, the transistor T2 is turned off, and the gate voltage stored in the storage capacitor C drives the transistor T1 so that the transistor T1 generates a current to drive the OLED and ensures that the OLED continuously emits light during one frame. The current to drive the thin film transistor T1 at a saturation state is represented as $I_{oled}=K(Vgs-Vth)^2$, where K is a parameter related to process and design, Vgs is a gate-source voltage for driving the thin film transistor, and Vth is a threshold voltage for driving the thin film transistor. Once the size and process for the transistor are determined, the parameter K is determined. FIG. 2 shows an operation timing chart of the pixel driving circuit as shown in FIG. 1, where the timing relationship between the scanning signal supplied from the scanning line and the data signal supplied from the data line are shown.

An AMOLED is driven by a current generated in a saturated state of the driven thin film transistors (DTFT), so that it is capable of emitting light. Difference of threshold voltages may exist for driving thin film transistors at different locations, due to process non-uniformity, regardless of a low-temperature polysilicon (LTPS) process or an oxide process. This difference is fatal for the uniformity of the current-driven devices since different threshold voltages generate different driving currents when the same drive voltages are applied, resulting in inconsistency of the currents flowing through the OLED leading to non-uniform display brightness, and thus affecting displaying effect of the display panel.

Therefore, there is a need for a method which can improve the uniformity of the driving current of the driving transistor and thereby improve the display quality.

SUMMARY

The present disclosure provides a pixel driving circuit, a pixel driving method, and a display device capable of improving display quality by compensating a threshold voltage of a driving unit of a light emitting element.

According to an aspect of the present disclosure, a pixel driving circuit for driving a light emitting element is provided. The pixel driving circuit comprises: a scanning line for supplying a scanning signal; a power supply line for supplying a voltage to the pixel driving circuit; a data line for supplying a data signal Vdata; a reference signal line for supplying a reference signal Vref; a first control signal line for supplying a first control signal; a driving unit having an input terminal connected to the first node, a control terminal connected to the third node and an output terminal connected to one terminal of the light emitting element; a first light emitting control unit having an input terminal connected to the power supply line, a control terminal connected to the first control signal line and an output terminal connected to the first node; a storage unit having a first terminal connected to the first node and a second terminal connected to the second node; a second emitting control unit having an input terminal connected to the second node, a control terminal connected to the first control signal line and an output terminal connected to the third node; a first charging control unit having a first input terminal connected to the data line, a second input terminal connected to the reference signal line, a control terminal connected to the scan line, a first output terminal connected to the second node and a second output terminal connected to the third node; a second charging control unit having an input terminal connected to the third node, a control terminal connected to the scan line and an output terminal connected to the output terminal of the drive unit.

The pixel driving circuit is configured so that, under control of the first control signal and the scan signal: during an initialization stage of the pixel driving circuit, the first light emitting control unit and the second light emitting control unit are turned on, the first charging control unit and the second charging control unit are turned off, thereby initializing the pixel driving unit; during a compensation stage of the pixel driving circuit, the first light emitting control unit and the second light emitting control unit are turned off, the first charging control unit and the second charging control unit are turned on, and the storage cell is charged until a voltage across the storage unit is equal to a value of Vdata−Vref+Vth, where Vth is a threshold voltage of the driving unit; and during a light emitting holding stage of the pixel driving circuit, the first light emitting control unit and the second light emitting control unit are turned on, and the first charging control unit and the second charging control unit are turned off, thereby the voltage across the storage unit remains unchanged so that a driving current supplied from the driving unit to the light emitting element is irrespective of the threshold voltage of the driving unit.

In one exemplary embodiment, the pixel driving circuit further comprises: a second control signal line for supplying a second control signal; a third emitting control unit having an input terminal connected to the output terminal of the driving unit, a control terminal connected to the second control signal line and an output terminal connected to one terminal of the light-emitting element. The pixel driving circuit is configured so that, under control of the second control signal, during the initialization stage, the third light emitting control unit is turned off, and during the compensation stage and the light-emitting holding stage, the third emitting control unit is turned on.

In one exemplary embodiment, the driving unit includes a driving transistor, the first emitting control unit includes a second transistor, the second emitting control unit includes a third transistor, the first charging control unit includes a fourth transistor and a fifth transistor, gates of which are connected together, the second charging control unit includes a sixth transistor, and the third light emitting control unit includes a seventh transistor.

In one exemplary embodiment, the storage unit includes a storage capacitor.

In one exemplary embodiment, during the initialization stage, the scan signal is at a high level and the first control signal is at a low level; during the compensation stage, the scan signal is at a low level and the first control signal is at a high level; and during the light-emitting holding stage, the scanning signal is at a high level and the first control signal is at a low level.

In one exemplary embodiment, during the initialization stage, the scan signal is at a high level, the first control signal is at a low level, and the second control signal is at a high level; during the compensation stage, the scan signal is at a low level, the first control signal is at a high level, and the second control signal is at a low level; and during the light-emitting holding stage, the scan signal is at a high level, the first control signal is at a low level, and the second control signal is at a low level.

According to another aspect of the present disclosure, a pixel driving method applied to a pixel driving circuit is provided. The pixel driving circuit comprising a scanning line for supplying a scanning signal; a power supply line for supplying a voltage to the pixel driving circuit; a data line for supplying a data signal Vdata; a reference signal line for supplying a reference signal Vref; a first control signal line for supplying a first control signal; a driving unit having an input terminal connected to the first node, a control terminal connected to the third node and an output terminal connected to one terminal of the light emitting element; a first light emitting control unit having an input terminal connected to the power supply line, a control terminal connected to the first control signal line and an output terminal connected to the first node; a storage unit having a first terminal connected to the first node and a second terminal connected to the second node; a second emitting control unit having an input terminal connected to the second node, a control terminal connected to the first control signal line and an output terminal connected to the third node; a first charging control unit having a first input terminal connected to the data line, a second input terminal connected to the reference signal line, a control terminal connected to the scan line, a first output terminal connected to the second node and a second output terminal connected to the third node; a second charging control unit having an input terminal connected to the third node, a control terminal connected to the scan line and an output terminal connected to the output terminal of the drive unit.

The pixel driving method comprises: during an initialization stage of the pixel driving circuit, controlling the first light emitting control unit and the second light emitting control unit to be turned on and the first charging control unit and the second charging control unit to be turned off, thereby initializing the pixel driving unit; during a compensation stage of the pixel driving circuit, controlling the first light emitting control unit and the second light emitting control unit to be turned off, and controlling the first charging control unit and the second charging control unit to be turned on, so that the storage cell is charged until a voltage across the storage unit is equal to a value of Vdata−Vref+Vth, where Vth is a threshold voltage of the driving unit; and during a light emitting holding stage of the pixel driving circuit, controlling the first light emitting control unit and the second light emitting control unit to be turned on, and controlling the first charging control unit and the second charging control unit to be turned off, thereby the voltage across the storage unit remains unchanged so that a driving current supplied from the driving unit to the light emitting element is irrespective of the threshold voltage of the driving unit.

According to another aspect of the present application, there is also provided a display device including the pixel driving circuit as described above.

BRIEF DESCRIPTION OF THE DRAWINGS

The above and other objects, features and advantages of the present disclosure will become more apparent from the following description of preferred embodiments of the present disclosure in conjunction with the accompanying drawings in which.

DETAILED DESCRIPTION

Exemplary embodiments of the present disclosure are described in detail below with reference to the accompanying drawings. In the following description, certain specific embodiments are provided for the purpose of description and should not be construed as limiting the present disclosure, but are merely exemplary examples of the present disclosure. In the event of confusion that may result in an understanding of the present disclosure, conventional structures or constructions will be omitted.

It will be understood by those skilled in the art that both of the switching transistor and the driving transistor employed in all embodiments of the present application may be thin film transistors or field effect transistors or other devices having the same characteristics. Preferably, the thin film transistor used in the embodiments of the present disclosure may be an oxide semiconductor transistor. A term of "control terminal" as used herein refers to a gate of a transistor, a term of "input terminal" refers to one of the source and drain of the transistor and a term of "output terminal" refer to the other one of the source and the drain of the transistor. Since the source and drain of the switching transistor as used here are symmetrical, the source and the drain of the switching transistor are interchangeable. In the embodiment of the present disclosure, in order to distinguish between the two electrodes of the transistor except for the gate, one of the electrodes is referred to as a source and the other one is referred to as a drain.

Figure 1:
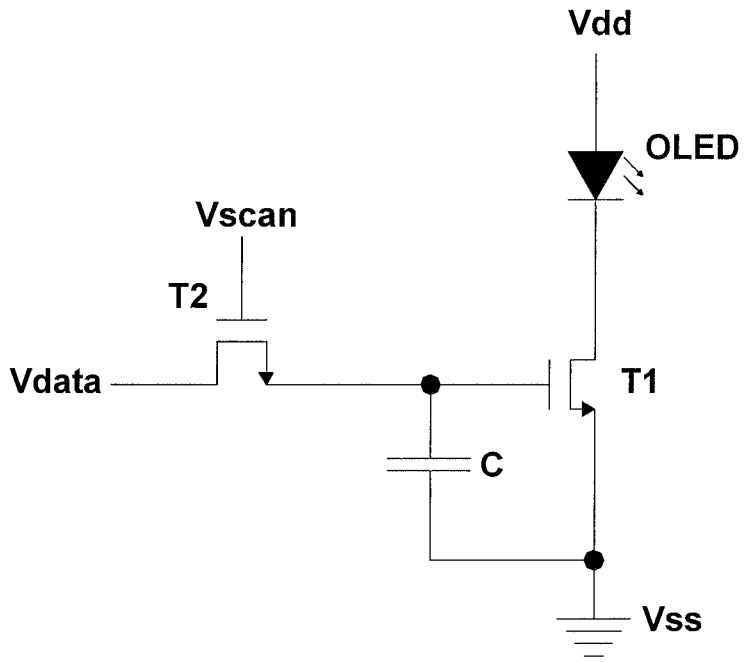
FIG. 1 is a schematic structural view of a conventional pixel driving circuit.
Figure 2:
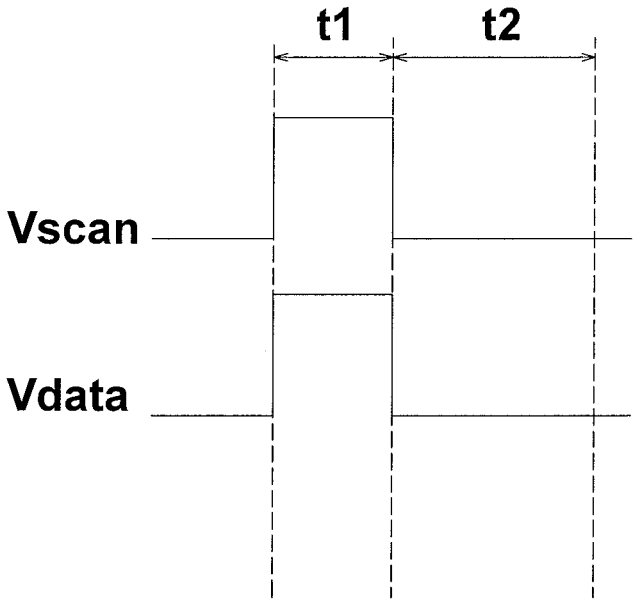
FIG. 2 is an operation timing chart of the pixel driving circuit of FIG. 1.
Figure 3A:
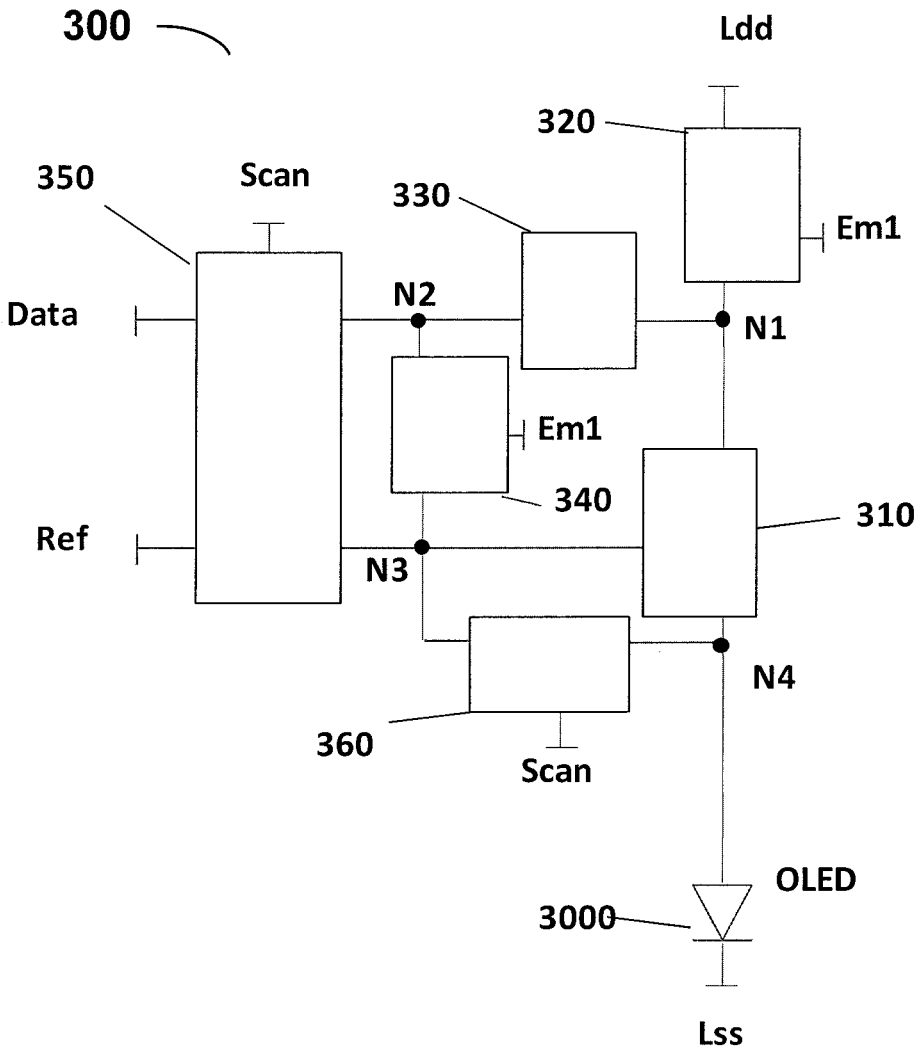
FIG. 3A is a schematic structural view of a pixel driving circuit in a display device according to a first embodiment of the present disclosure.
Figure 3B:
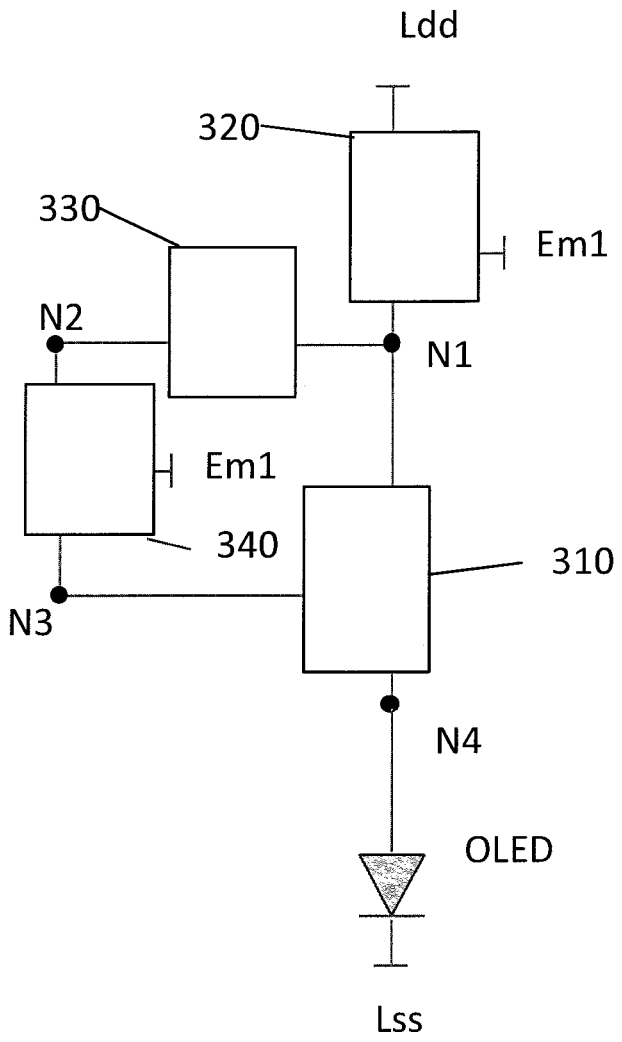
FIGS. 3B-3D are schematic diagrams respectively showing an equivalent circuit configuration of the pixel driving circuit of FIG. 3A during the initialization stage, the compensation stage and the light-emitting holding stage according to the first embodiment of the present disclosure.
Figure 3C:
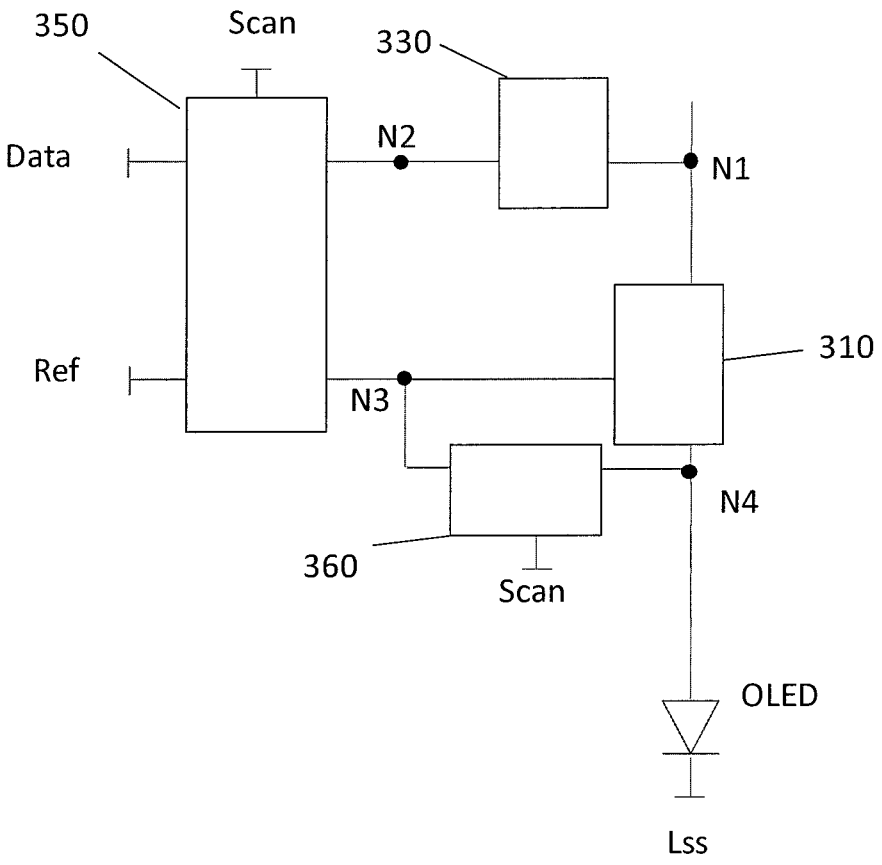
Figure 3D:
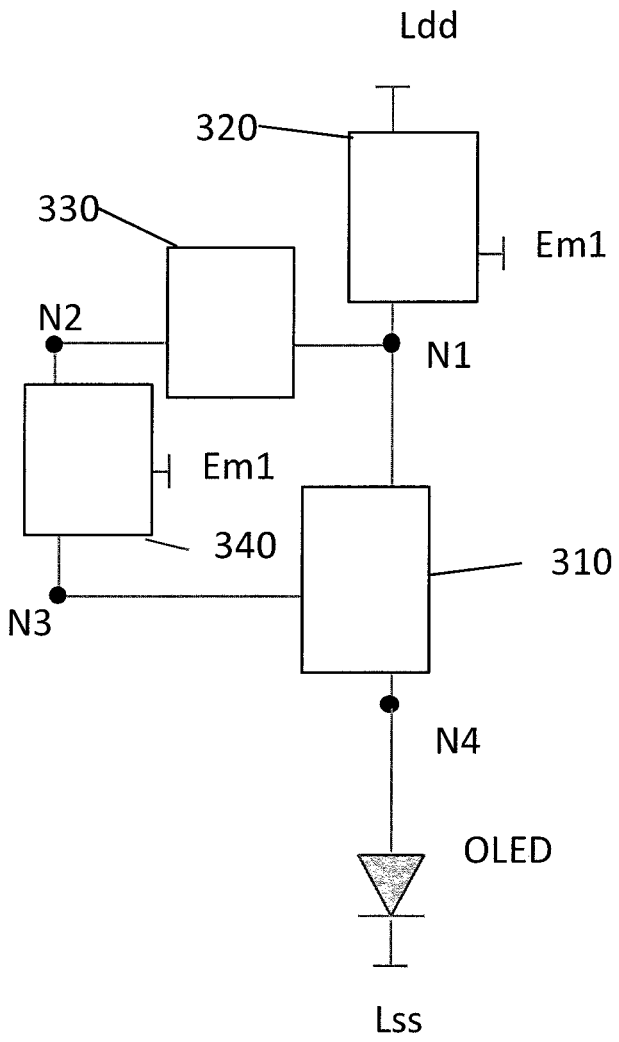

FIG. 3A is a schematic structural view of a pixel driving circuit 300 in a display device according to a first embodiment of the present disclosure. FIGS. 3B-3D are schematic diagrams respectively showing an equivalent circuit configuration of the pixel driving circuit of FIG. 3A during the initialization stage, the compensation stage and the light-emitting holding stage according to the first embodiment of the present disclosure.

As shown in FIG. 3A, the pixel driving circuit 300 is used to drive the light emitting element 3000, in which the light emitting element 3000 is shown as a light emitting diode OLED. As shown FIG. 3A, the pixel driving circuit 300 of the present disclosure may include a scan line Scan for supplying a scan signal Vscan, a power supply line including a first power supply line Lss and a second power supply line Ldd for respectively supplying voltages Vss and Vdd to the pixel driving circuit 300; and a data line Data for supplying the data signal Vdata, where Vss may be equal to zero.

As shown in FIG. 3A, the pixel driving circuit 300 may further comprise a reference signal line Ref for supplying a reference signal Vref, and a first control signal line Em1 for supplying a first control signal Vem1.

As shown in FIG. 3A, the pixel driving circuit 300 may further comprise a driving unit 310 having an input terminal connected to the first node N1, a control terminal connected to the third node N3, and an output terminal connected to the fourth node N4. The light emitting element 3000 is connected between the fourth node N4 and the first power supply line Lss; a first light emitting control unit 320 having an input terminal connected to the second power supply line Ldd, a control terminal connected to the first control signal line Em1, and an output terminal connected to the first node N1; a storage unit 330 having a first terminal connected to the first node N1 and a second terminal connected to the second node N2; a second emitting control unit 340 having an input terminal connected to the second node N2, a control terminal connected to the first control signal line Em1, and an output terminal connected to the third node N3; a first charging control unit 350 having a first input terminal connected to the data line Data, a second input terminal connected to the reference signal line Ref, a control terminal connected to the first control signal line Em1, where the first output terminal is connected to the second node N2 and the second output terminal is connected to the third node N3; and a second charging control unit 360 having an input terminal connected to the third node N3, a control terminal connected to the scan line Scan, and an output terminal connected to the fourth node N4.

During the initializing stage of the pixel driving circuit 300, the equivalent circuit configuration of the pixel driving circuit 300 is shown in FIG. 3B, in which under control of the first control signal and the scanning signal, the first light-emitting control unit 320 and the second light-emitting control unit 340 are turned on, and the first charging control unit 350 and the second charging control unit 360 are turned off, thereby the driving unit 310 is initialized. That is to say, the voltage Vn1 of the first node N1 is made to be equal to Vdd, Vn1=Vdd.

During the compensation stage of the pixel driving circuit 300, an equivalent circuit configuration of the pixel driving circuit 300 is shown in FIG. 3C, in which under control of the first control signal and the scanning signal, the first light emitting control unit 320 and the second light emitting control unit 340 are turned off, and the first charging control unit 350 and the second charging control unit 360 are turned on. Thus, the signal Vdata is written into the second node N2 through the data line Data, the signal Vref is written into the third node N3 and the fourth node N4 through the reference signal line Ref. The storage unit 330 is charged until the voltage across the storage unit 330 is equal to Vdata−Vref+Vth, where Vth is the threshold voltage of the driving cell 310.

During the light-emitting holding stage of the pixel driving circuit 300, the equivalent circuit configuration of the pixel driving circuit 300 is shown in FIG. 3D, in which under control of the first control signal and the scanning signal, the first light emitting control unit 320 and the second light-emitting control unit 340 are turned on and the first charging control unit 350 and the second charging control unit 360 are turned off so that the voltage across the storage unit 330 remains unchanged and the driving current supplied from the driving unit 310 to the light emitting element 3000 is irrespective of the threshold voltage of the driving unit 310.

Figure 4A:
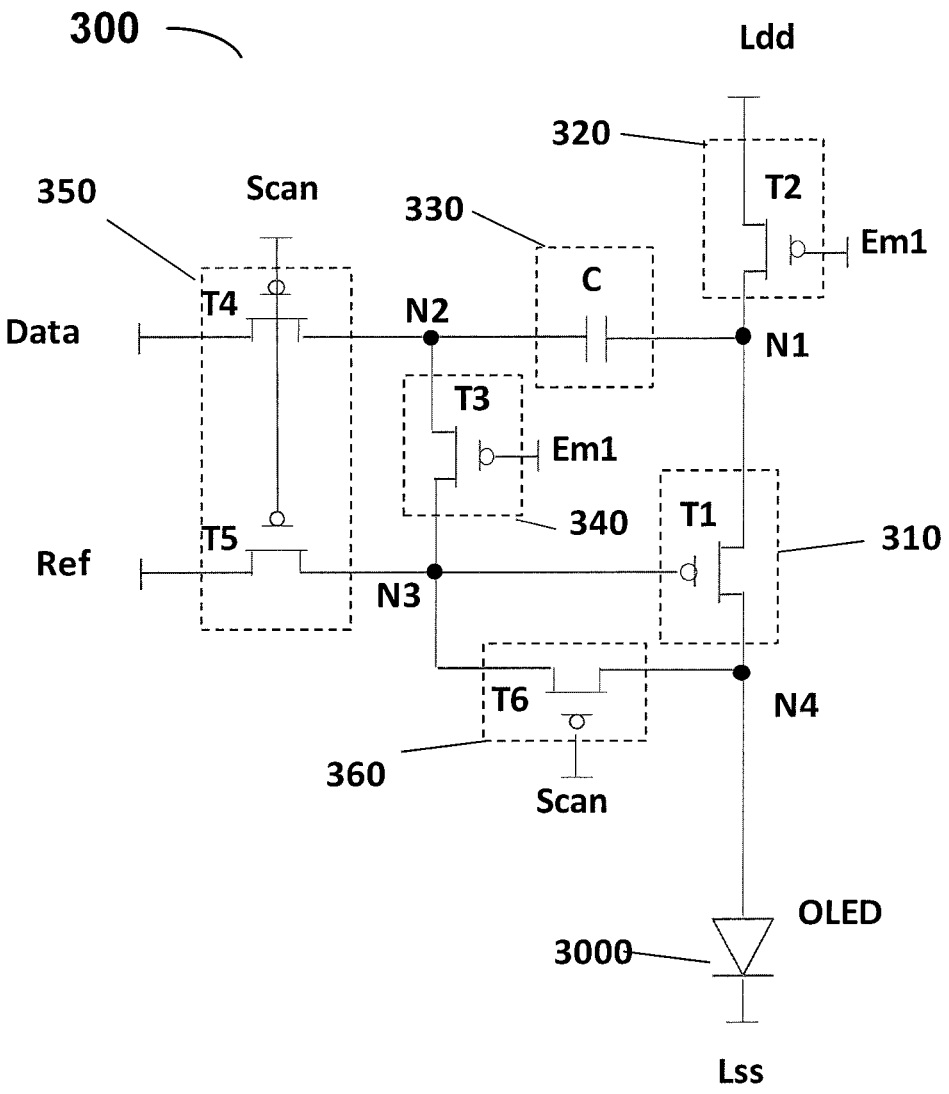
FIG. 4A is a specific structural diagram of the pixel driving circuit in the display device according to the first embodiment of the present disclosure.
Figure 4B:
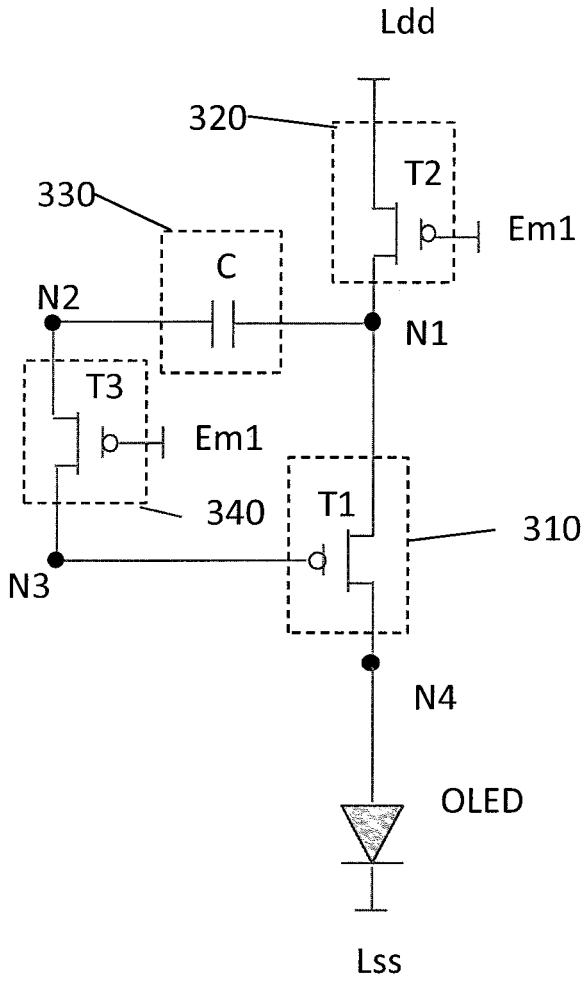
FIGS. 4B-4D are schematic diagrams respectively showing an equivalent circuit configuration of the pixel driving circuit of FIG. 4A during the initialization stage, the compensation stage and the light-emitting holding stage according to the first embodiment of the present disclosure.
Figure 4C:
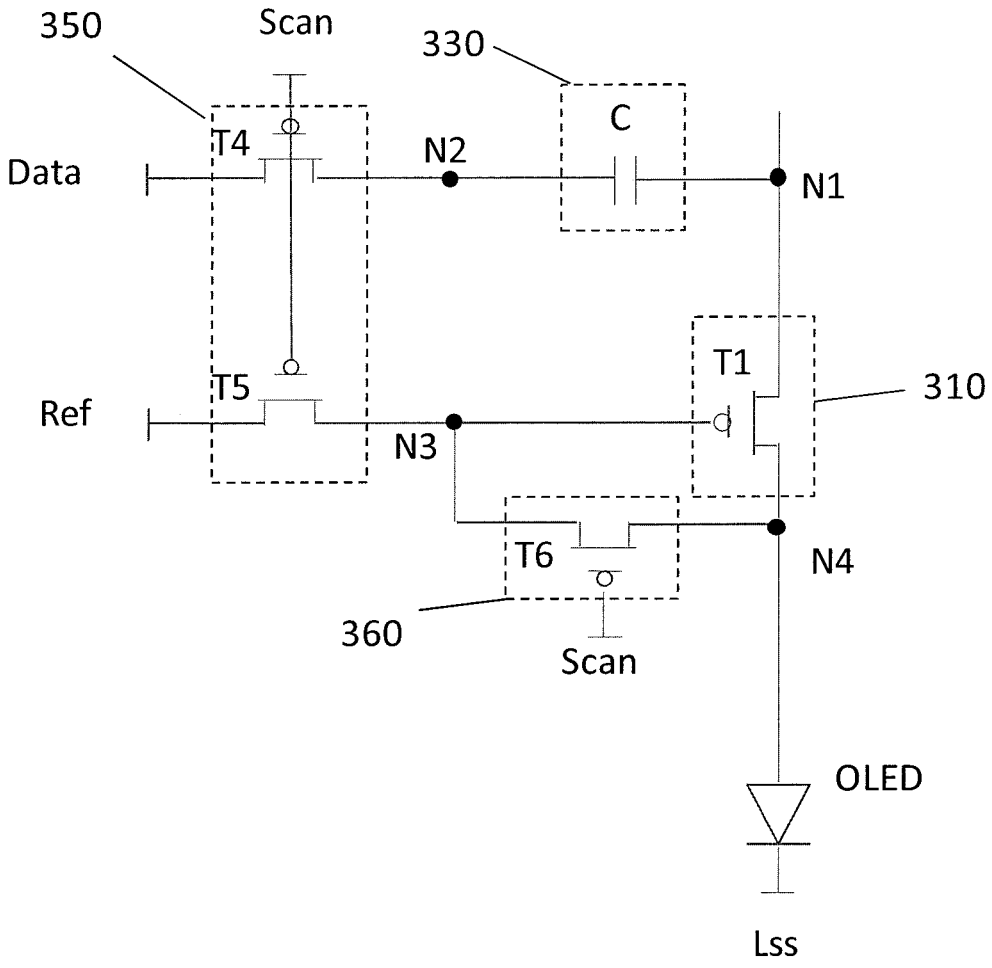
Figure 4D:
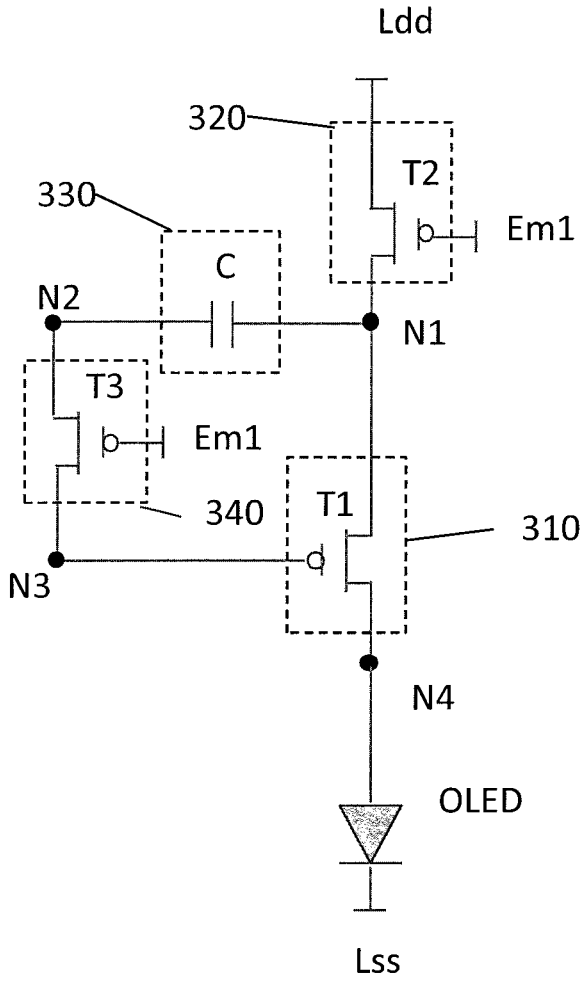

FIG. 4A is a specific structural diagram of the pixel driving circuit 300 in the display device according to the first embodiment of the present disclosure; FIGS. 4B-4D are schematic diagrams respectively showing an equivalent circuit configuration of the pixel driving circuit 300 of FIG. 4A during the initialization stage, the compensation stage and the light-emitting holding stage according to the first embodiment of the present disclosure.

As compared with FIG. 3A, FIG. 4A shows exemplary example of the driving unit 310, the first emitting control unit 320, the storage unit 330, the second emitting control unit 340, the first charging control unit 350 and the second charging control unit 360. It will be readily understood by those skilled in the art that the implementations of the above elements are not so limited as long as the respective functions can be implemented.

As shown in FIG. 4A, in the pixel driving circuit 300 according to an embodiment of the present disclosure, the driving unit 310 includes a driving transistor T1, a source, a gate and a drain of which correspond to the input terminal, the control terminal and the output terminal of the driving unit, respectively. The first light-emitting control unit 320 includes a second transistor T2, a source, a gate and a drain of which correspond to the input terminal, the control terminal and the output terminal of the first light-emitting control unit 320, respectively. The storage unit 330 includes a storage capacitor C connected between the first node N1 and the second node N2. The second light emitting control unit 340 includes a third transistor T3, a source, a gate and a drain of which correspond to the input terminal, the control terminal and the output terminal of the second light emitting control unit 340, respectively. The first charging control unit 350 includes a fourth transistor T4 and a fifth transistor T5. The gate of the fourth transistor is connected to that of the fifth transistor. The gate of the fourth transistor T4 and the fifth transistor T5 correspond to the control terminal of the first charging control unit 350. The source and the drain of the fourth transistor T4 correspond to the first input terminal and the first output terminal of the first charging control unit 350, respectively. The source and the drain electrode of the fifth transistor T5 correspond to the second input terminal and the second output terminal of the first charging control unit 350. The second charging control unit 360 includes a sixth transistor T6, a source, a gate and a drain of which correspond to the input terminal, the control terminal and the output terminal of the second charging control unit 360, respectively.

The driving transistor T1, the second transistor T2, the third transistor T3, the fourth transistor T4, the fifth transistor T5 and the sixth transistor T6 as shown in FIG. 4A may be N-type thin film transistors or P-type thin film transistors. The source and drain of the transistor may be interchanged depending on the type of the used transistor.

FIGS. 4B-4D are equivalent circuits corresponding to FIGS. 3B-3D, where the exemplary configurations of the driving unit 310, the first light emitting control unit 320, the storage unit 330, the second light emitting control unit 340, the first charging control unit 350 and the second charging control unit 360 in FIGS. 3B-3D are specifically shown according to the structure in FIG. 4A. It will be readily understood by those skilled in the art that the implementations of the above elements are not so limited as long as the respective functions can be implemented.

Figure 5:
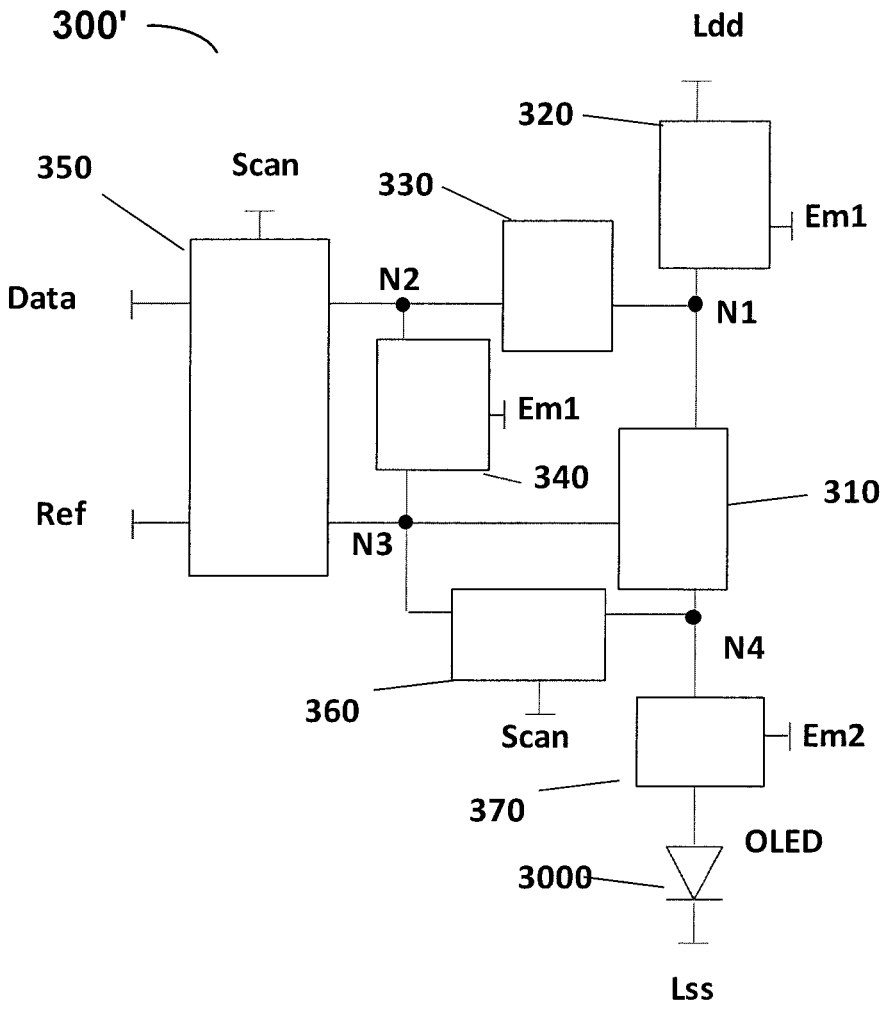
FIG. 5 is a schematic structural view of a pixel driving circuit in a display device according to a second embodiment of the present disclosure.
Figure 6:
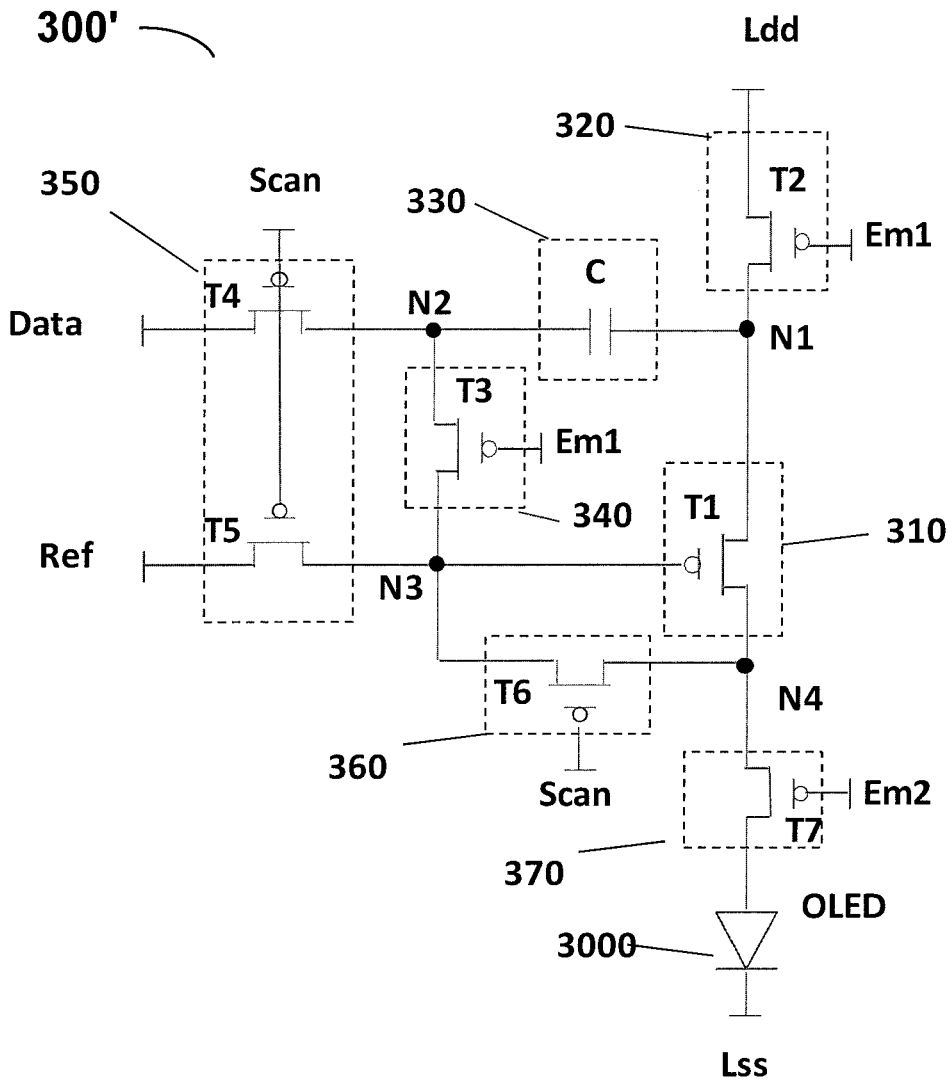
FIG. 6 is a specific structural schematic diagram of the pixel driving circuit in the display device according to the second embodiment of the present disclosure.

FIG. 5 is a schematic structural view of a pixel driving circuit 300' in a display device according to a second embodiment of the present disclosure. FIG. 6 is a specific structural schematic diagram of the pixel driving circuit 300' in the display device according to the second embodiment of the present disclosure. The difference of the pixel driving circuit 300' over the pixel driving circuit 300 as shown in FIGS. 3A-3D and FIG. 4A lies in that the pixel driving circuit 300' further comprises a second control signal line Em2 for supplying the second control signal Vem2; a third light emitting control unit 370 having an input terminal connected to the fourth node N4, a control terminal connected to the second control signal line Em2 and an output terminal connected to one end of the light-emitting element such as an anode. Under control of the second control signal, the third light emitting control unit 370 is turned off during the initialization stage, and the third light emitting control unit 370 is turned on during the compensation stage and the light emission holding stage.

FIG. 6A further shows an exemplary structure of the third light emitting control unit 370 according to the second embodiment of the present disclosure. It will be readily understood by those skilled in the art that the implementation is not so limited as long as the function can be performed. Specifically, the third light emitting control unit 370 may include a seventh transistor T7, a source, a gate and a drain of which correspond to the input terminal, the control terminal and the output terminal of the third light emitting control unit 370, respectively.

The seventh transistor T7 as shown in FIG. 6 may be an N-type thin film transistor or a P-type thin film transistor. The source and drain of the seventh transistor T7 are interchanged depending on the type of the transistor in use.

Figure 7:
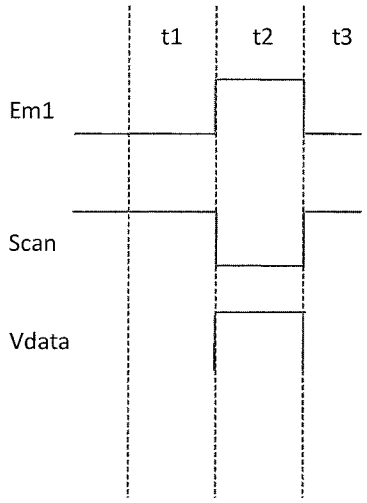
FIG. 7 is a schematic timing chart of a control signal for the pixel driving circuit according to the first embodiment of the present disclosure.

FIG. 7 is a schematic timing chart of a control signal for the pixel driving circuit according to the first embodiment of the present disclosure. In the following, the operation timing of the pixel driving circuit according to the first embodiment of the present disclosure will be described with reference to FIGS. 4A-4D and FIG. 7. In order to facilitate explanation, it is assumed that each of the transistors is an N-type transistor in this embodiment, and these transistors are turned on when the gate is at a low level and are turned off when the gate is at a high level. Therefore, the low level of the scanning signal Vscan is the valid level. The high level of the power supply is shown as Vdd, and the low level is shown as Vss. It is appreciated for those skilled in the art that this application is not so limited.

First, during the first time period t1, the scanning signal Vscan is at a high level, and the first control signal Vem1 is at a low level. Therefore, the transistors T2 and T3 are turned on, and the transistors T4, T5 and T6 are turned off. At this time, since the second transistor T2 is turned on, the level Vdd supplied from the second power supply line Ldd is written to the first node N1, that is, Vn1=Vdd. The voltages Vn2 and Vn3 at the nodes N2 and N3 are the data voltage of the previous frame or arbitrary voltage Vx after starting up, i.e. Vn2=Vn3=Vx. Therefore, the voltage Vc across both ends of the capacitor C at this time is shown as: Vc=Vn2−Vn1=Vx−Vdd. Since Vn1=Vdd, transistor T1 is initialized. Such a stage may be referred to as an initialization stage.

During the second time period t2, the scanning signal Vscan is at a low level, the first control signal Vem1 is at a high level, and the data signal Vdata supplied from the data line Data is at a high level. Therefore, the transistors T4, T5 and T6 are turned on, and the transistors T2 and T3 are turned off. At this time, the data signal Vdata is written into the second node N2, and the reference voltage Vref supplied from the reference signal line Ref is written into the third node N3, so that Vn2=Vdata and Vn3=Vref. Under control of the reference voltage Vref, the gate voltage of the driving transistor T1 is Vref and the level of the source voltage Vn1 falls from the high level Vdd to Vref−Vth, where Vth is the threshold voltage of the driving transistor T1. Thus, the source voltage Vs of the driving transistor compensates Vth such that Vs=Vref−Vth. At this time, the gate-source voltage Vgs of the driving transistor T1 is Vgs=Vn3−Vn1=Vref−(Vref−Vth)=Vth. The driving transistor T1 is in a saturated state and outputs a current to the light emitting element 3000 so that the light emitting element 3000 starts to emit light. The voltage Vc across the capacitor C is shown as Vc=Vn2−Vn1=Vdata−Vref+Vth. Since the source voltage of the driving transistor T1 at this time is equal to Vref−Vth, which is irrespective of Vdd, the influence of the IR drop in Vdd is eliminated. In addition, since the sixth transistor T6 is turned on, the voltage Vn4 of the fourth node N4 is Vref, so that the anode voltage of the previous frame of the OLED 3000 can be cleared. Such a stage may be referred to as the compensation stage.

During the third time period t3, the scanning signal Vscan is at the high level, and the first control signal Vem1 is at the low level. Accordingly, the transistors T2 and T3 are turned on, and the transistors T4, T5 and T6 are turned off. At this time, the both ends of the capacitor C are connected to the gate and the source of the driving transistor T1, respectively, and the end of the capacitor C which is connected to the gate of the driving transistor T1 (the third node N3) is floated. Therefore, any voltage change at the first node N1 is fed back to the third node N3, that is, the voltage difference across the capacitor C (i.e., Vgs) does not change, Vgs=Vdata−(Vref−Vth). Such a stage may be referred to as a light-emitting holding stage. At this time, Vgs≤Vds+Vth, so the driving transistor T1 is in a stable saturated state, and the current flowing through the OLED 3000 is:

$$I_{oled}=K(V\text{gs}-V\text{th})^2=K[V\text{data}-(V\text{ref}-V\text{th})-V\text{th}]^2=K(V\text{data}-V\text{ref})^2,$$

where K is a constant related to the process parameters and geometric dimensions of the driving transistor T1.

As can be seen from the above equation, the light emitting current Ioled for driving the OLED is only related to the reference voltage Vref and the data voltage Vdata, irrespective of the threshold voltage Vth of the driving transistor. Since there is not a path for the capacitor C to be charged or discharged, even if the voltage Vdd changes during the light-emitting stage, the charge in the capacitor C and the voltage across the capacitor both remain unchanged according to the principle of charge conservation since there is not a loop for consuming the charges. Thus, the current flowing through the OLED remains $I=K(\text{Vdata}-\text{Vref})^2$, and the OLED maintains this light emitting state. It is possible to improve uniformity of the current and achieve uniformity of the luminance. The reference voltage Vref may be set to a voltage such as Vss or 0V.

During the subsequent time periods, the respective control signals are the same as those of the stage t3, so that the light emitting state of the OLED is maintained until the low valid level of the scanning signal Vscan comes again.

Figure 8:
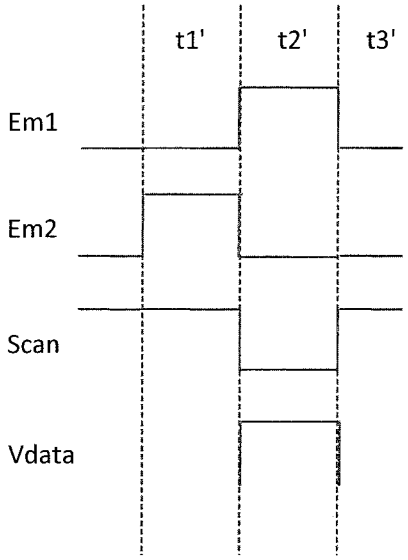
FIG. 8 is a schematic timing chart of a control signal for the pixel driving circuit according to the second embodiment of the present disclosure.

FIG. 8 is a schematic timing chart of a control signal for the pixel driving circuit according to the second embodiment of the present disclosure. In the following, the operation timing of the pixel driving circuit according to the second embodiment of the present disclosure will be described with reference to FIGS. 5, 6 and 8. In this embodiment, similar to the case of the first embodiment, each of the transistors is an N-type transistor, and the N-type transistor is turned off when the gate is at a low level and is turned off at a high level. Therefore, the low level of the scanning signal Vscan is the valid level. The high level of the power supply is shown as Vdd and the low level is shown as Vss.

Firstly, during the first time period t1', the scanning signal Vscan is at a high level, the first control signal Vem1 is at a low level, and the second control signal Vem2 is at a high level. Therefore, the transistors T2 and T3 are turned on, and the transistors T4, T5, T6 and T7 are turned off. Since the second control signal Vem2 is at a high level, the transistor T7 is turned off and there is no current flowing through the driving transistor T1 and the light emitting element, so that the initialization of the transistor T1 can be better realized. The other operations of the circuit at such a stage are the same as those of the circuit at the initialization stage according to the first embodiment.

During the second time period t2', the scanning signal Vscan is at a low level, the first control signal Vem1 is at a high level, and the second control signal Vem2 is at a low level. Therefore, the transistors T4, T5, T6 and T7 are turned on, and the transistors T2 and T3 are turned off. It can be seen that this is substantially the same as the equivalent circuit in the compensation stage of the pixel driving circuit according to the first embodiment, and thus the operation of the circuit is also the same and will not be described here for brevity.

During the third time period t3', the scanning signal Vscan is at a high level, the first control signal Vem1 is at a low level, and the second control signal Vem2 is at a low level. Accordingly, the transistors T2, T3 and T7 are turned on, and the transistors T4, T5 and T6 are turned off. It can be seen that this is substantially the same as the equivalent circuit in the light-emitting holding stage of the pixel driving circuit according to the first embodiment. Thus, the operation of the circuit is also the same and will not be described here for brevity.

Figure 9:
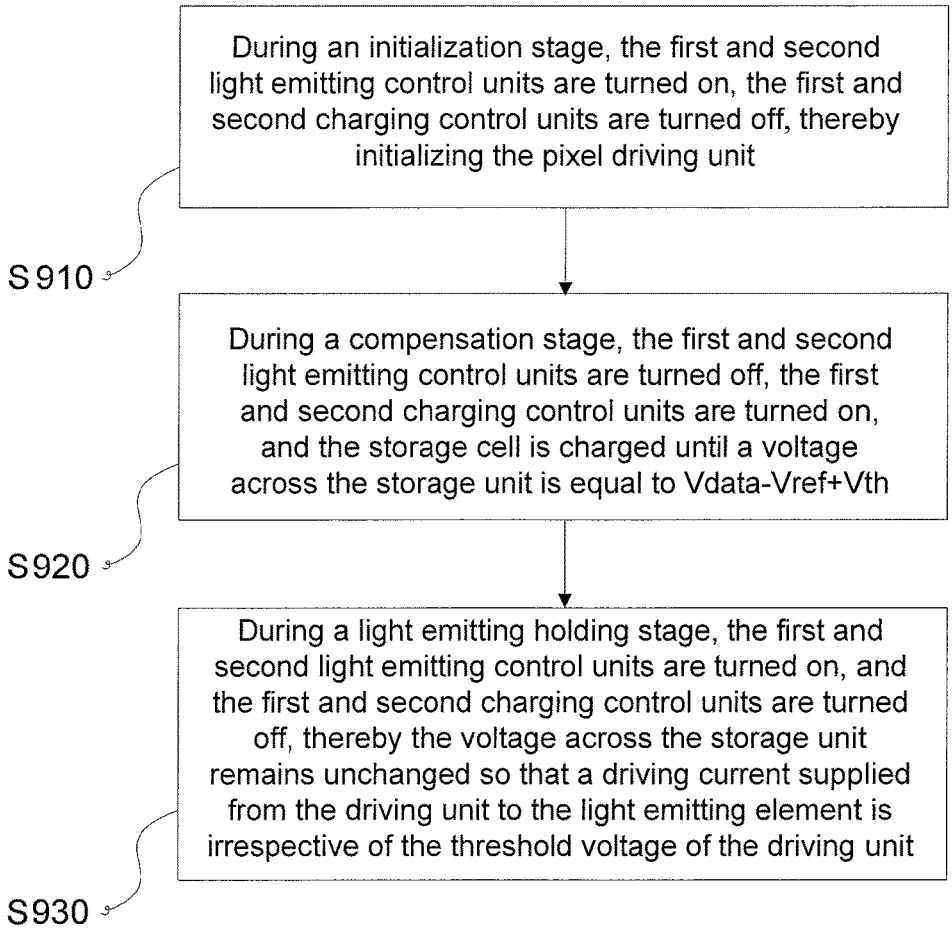
FIG. 9 illustrates a flow chart of the pixel driving method according to an embodiment of the present disclosure.

FIG. 9 illustrates a flow chart of the pixel driving method according to an embodiment of the present disclosure, which is applied to the pixel driving circuit according to the first embodiment of the present disclosure. As shown in FIG. 9, the pixel driving method comprises the following steps.

At a step of S910, an initialization stage of the pixel driving circuit is implemented, in which the first light emitting control unit and the second light emitting control unit are controlled to be turned on and the first charging control unit and the second charging control unit are controlled to be turned off, thereby initializing the pixel driving unit;

At a step of S920, a compensation stage of the pixel driving circuit is implemented, in which the first light emitting control unit and the second light emitting control unit are controlled to be turned off, and the first charging control unit and the second charging control unit are controlled to be turned on, so that the storage cell is charged until the voltage across the storage unit is equal to Vdata−Vref+Vth, where Vth is the threshold voltage of the driving unit;

At a step of S930, a light emitting holding stage of the pixel driving circuit is implemented, in which the first light emitting control unit and the second light emitting control unit are controlled to be turned on, and the first charging control unit and the second charging control unit are controlled to be turned off, thereby the voltage across the storage unit remains unchanged so that the driving current supplied from the driving unit to the light emitting element is irrespective of the threshold voltage of the driving unit.

Figure 10:
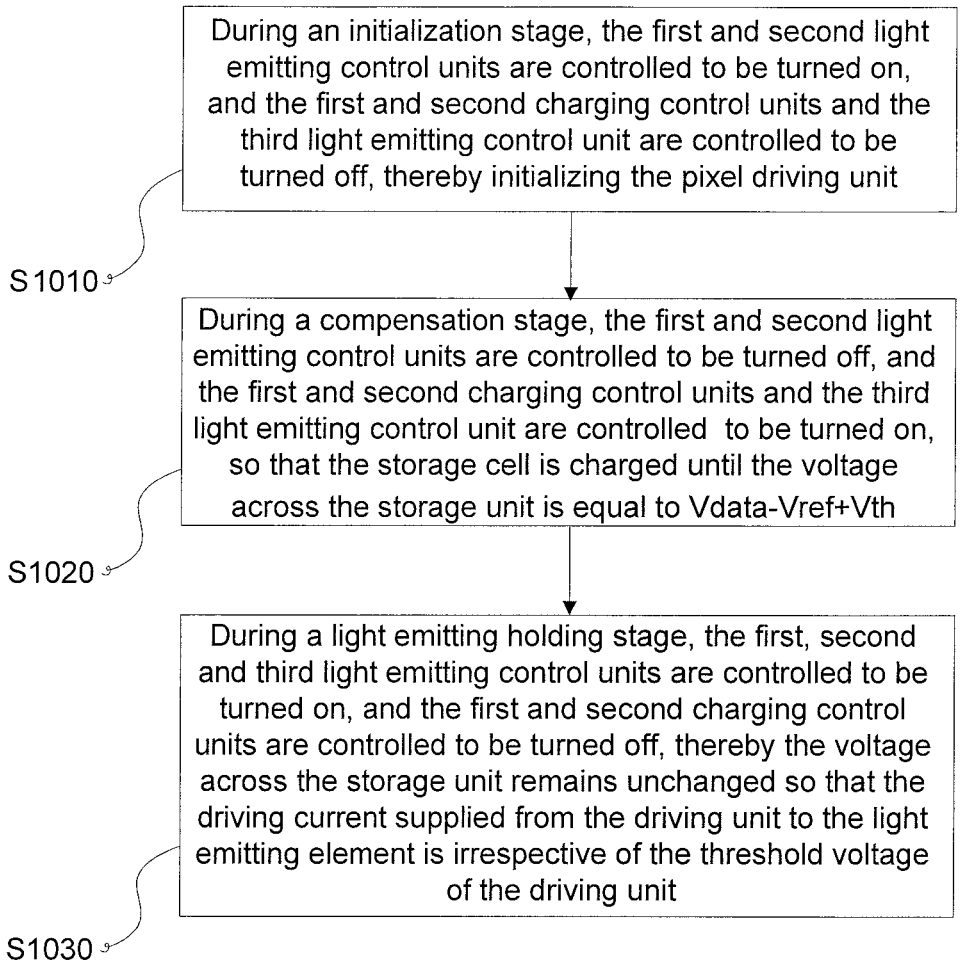
FIG. 10 illustrates a flow chart of a pixel driving method according to another embodiment of the present disclosure.

FIG. 10 illustrates a flow chart of the pixel driving method according to another embodiment of the present disclosure, which is applied to the pixel driving circuit according to the second embodiment of the present disclosure. As shown in FIG. 10, the pixel driving method comprises the following steps.

At a step of S1010, an initialization stage of the pixel driving circuit is implemented, in which the first light emitting control unit and the second light emitting control unit are controlled to be turned on and the first charging control unit, the second charging control unit and the third light emitting control unit are controlled to be turned off, thereby initializing the pixel driving unit;

At a step of S1020, a compensation stage of the pixel driving circuit is implemented, in which the first light emitting control unit and the second light emitting control unit are controlled to be turned off, and the first charging control unit, the second charging control unit and the third light emitting control unit are controlled to be turned on, so that the storage cell is charged until the voltage across the storage unit is equal to Vdata−Vref+Vth, where Vth is the threshold voltage of the driving unit;

At a step of S1030, a light emitting holding stage of the pixel driving circuit is implemented, in which the first light emitting control unit, the second light emitting control unit and the third light emitting control are controlled to be turned on, and the first charging control unit and the second charging control unit are controlled to be turned off, thereby the voltage across the storage unit remains unchanged so that the driving current supplied from the driving unit to the light emitting element is irrespective of the threshold voltage of the driving unit.

The pixel driving circuit provided by the present disclosure has been described in detail above. In addition, the present disclosure provides a display device including the above pixel driving circuit.

The disclosure has been described in connection with a preferred embodiment. It will be understood by those skilled in the art that various other changes, substitutions and additions may be made thereto without departing from spirit and scope of the present disclosure. Accordingly, the scope of the present disclosure is not limited to the specific embodiments described above, but should be defined by the appended claims.

We claim:

1. A pixel driving method applied to a pixel driving circuit for driving a light emitting element, the pixel driving method comprising:

during an initialization stage of the pixel driving circuit, controlling a first light emitting control unit and a second light emitting control unit of the pixel driving circuit to be turned on, and controlling a first charging control unit, a second charging control unit and a third light emitting control unit of the pixel driving circuit to be turned off, thereby initializing the pixel driving circuit;

during a compensation stage of the pixel driving circuit, controlling the first light emitting control unit and the second light emitting control unit to be turned off, and controlling the first charging control unit, the second charging control unit and the third light emitting control unit to be turned on, so that a storage unit of the pixel driving circuit is charged until a voltage across the storage unit is equal to Vdata−Vref+Vth, wherein Vth is a threshold voltage of a driving unit of the pixel driving circuit; and during a light emitting holding stage of the pixel driving circuit, controlling the first light emitting control unit, the second light emitting control unit and the third light emitting control unit to be turned on, and controlling the first charging control unit and the second charging control unit to be turned off, thereby the voltage across the storage unit remains unchanged so that a driving current supplied from the driving unit to the light emitting element is irrespective of the threshold voltage of the driving unit;

wherein the pixel driving circuit comprises:

a scanning line for supplying a scanning signal;

a power supply line for supplying a voltage to the pixel driving circuit;

a data line for supplying a data signal;

a reference signal line for supplying a reference signal;

a first control signal line for supplying a first control signal;

a second control signal line for supplying a second control signal;

the driving unit having an input terminal connected to a first node, a control terminal connected to a third node and an output terminal connected to one terminal of the light emitting element;

the first light emitting control unit having an input terminal connected to the power supply line, a control terminal connected to the first control signal line and an output terminal connected to the first node;

the storage unit having a first terminal connected to the first node and a second terminal connected to the second node;

the second emitting control unit having an input terminal connected to the second node, a control terminal connected to the first control signal line and an output terminal connected to the third node;

the first charging control unit having a first input terminal connected to the data line, a second input terminal connected to the reference signal line, a control terminal connected to the scanning line, a first output terminal connected to the second node and a second output terminal connected to the third node, wherein the first charging control unit is configured to transmit the data signal from the data line to the second node under control of the scanning signal, and transmit the reference signal from the reference signal line to the third node under control of the scanning signal;

the second charging control unit having an input terminal connected to the third node, a control terminal connected to the scanning line and an output terminal connected to the output terminal of the driving unit;

the third emitting control unit having an input terminal connected to the output terminal of the driving unit, a control terminal connected to the second control signal line and an output terminal connected to one terminal of the light-emitting element;

wherein during the initialization stage, the scanning signal is at a high level, the first control signal is at a low level, and the second control signal is at a high level;

during the compensation stage, the scanning signal is at a low level, the first control signal is at a high level, and the second control signal is at a low level; and during the light-emitting holding stage, the scanning signal is at a high level, the first control signal is at a low level, and the second control signal is at a low level.

* * * * *